United States Patent [19]

Jaakkola

[11] Patent Number: 4,948,466

[45] Date of Patent: Aug. 14, 1990

[54] METHOD FOR HEATING A CYLINDER OR ROLL WITH AN ELECTRICALLY CONDUCTIVE CERAMIC OUTER LAYER

[75] Inventor: Jyrki Jaakkola, Korpilahti, Finland

[73] Assignee: Valmet Paper Machinery Inc., Finland

[21] Appl. No.: 337,635

[22] Filed: Apr. 13, 1989

[30] Foreign Application Priority Data

Apr. 13, 1988 [FI] Finland ..... 881711

[51] Int. Cl.[5] ..... D21F 3/00

[52] U.S. Cl. ..... 162/207; 162/206; 162/358; 162/359; 162/360.1; 100/38; 219/10.492; 219/10.61 A

[58] Field of Search ..... 162/206, 207, 358, 359, 162/360.1; 29/132, 130; 100/38, 93 RP, 92, 93 R; 219/10.492, 10.61 A, 469, 470

[56] References Cited

U.S. PATENT DOCUMENTS

| | | | |
|---|---|---|---|
| 4,324,613 | 4/1982 | Wahren | 162/206 |
| 4,631,794 | 12/1986 | Rihinen | 29/132 |
| 4,653,395 | 3/1987 | Verkasalo | 100/38 |
| 4,675,487 | 6/1987 | Verkasalo | 219/10.61 A |
| 4,704,776 | 11/1987 | Watanabe et al. | 29/132 |
| 4,796,342 | 1/1989 | Mihkiren | 29/132 |
| 4,830,683 | 5/1989 | Fergusson | 148/11.5 R |

FOREIGN PATENT DOCUMENTS 123490 10/1984 European Pat. Off. ..... 29/132

*Primary Examiner*—Karen M. Hastings
*Attorney, Agent, or Firm*—Steinberg & Raskin

[57] ABSTRACT

Method and arrangement in a machine for the manufacture of paper or board, for heating an outer face of a cylinder or roll which is in direct contact with a web to be pressed thereagainst. The cylinder or roll face is heated from outside inductively by using a magnetic field, and by which a heating effect based on eddy currents is produced in the outer layer of the roll or cylinder. A relatively thin outer layer of an electrically conductive ceramic material is used as the cylinder or roll face, in which the resistive heating effect is concentrated. The depth of penetration of the heating effect in the radial direction of the roll of cylinder to be heated is restricted to a sufficiently low depth by choosing the thickness of the ceramic outer layer and/or the electric frequency of the induction heating. Additionally, on the basis of its electrical properties, the ceramic material of the outer layer is chosen so that the cylinder or roll face is provided with the necessary properties of strength, and is also chosen in view of the thermal shock of the heating effect.

15 Claims, 7 Drawing Sheets

FIG. 1
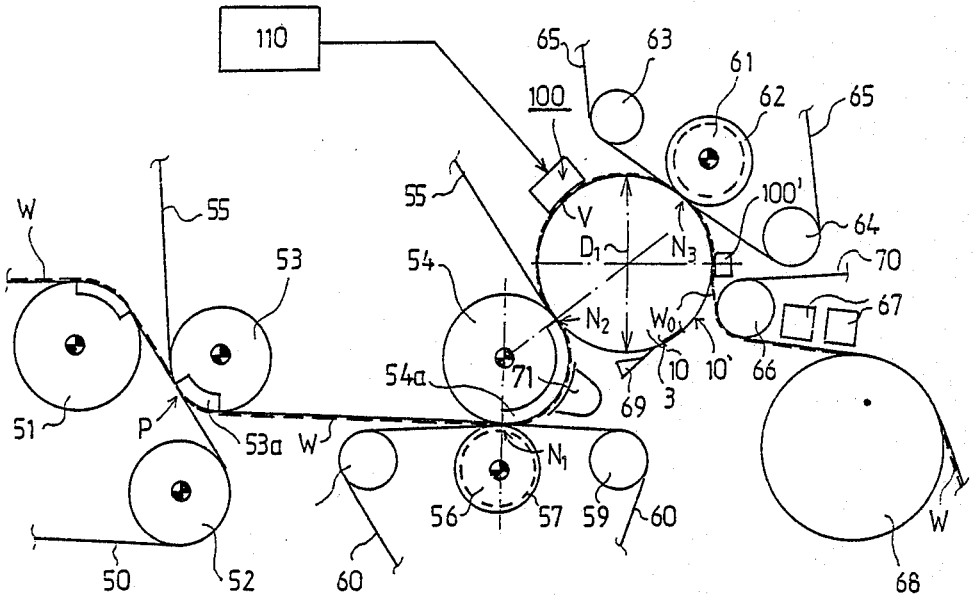
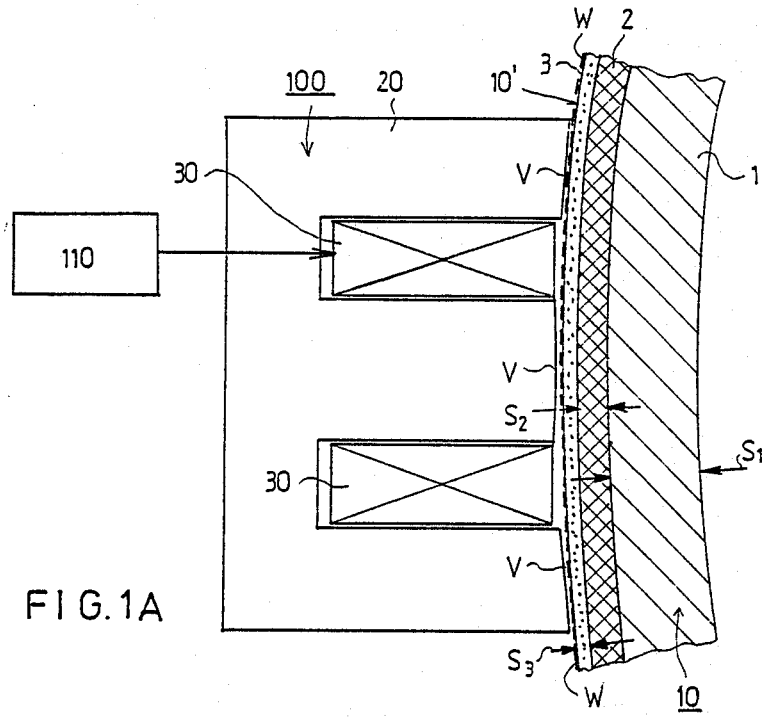
FIG. 1A

METHOD FOR HEATING A CYLINDER OR ROLL WITH AN ELECTRICALLY CONDUCTIVE CERAMIC OUTER LAYER

BACKGROUND OF THE INVENTION

The present invention concerns a method in a machine for the manufacturing of paper or board, for heating an outer face of such a cylinder or roll which is in direct contact with the web to be pressed against said roll face. The web is treated, such as being dewatered or calendered, by means of the method.

The present invention also concerns a device for the press treatment of a paper web intended for carrying out the method in accordance herewith, this device comprising a cylinder or roll having an outer face which can be heated, and in connection with which one or several roll nips and/or so-called extended nips are formed.

As is known in the prior art, water can be removed from a paper web by means of pressing, so that the dry solids content of the web is ka≅40 . . . 45%. The rest of the water has had to be removed by evaporation, which consumes essentially more energy per unit of mass than is consumed by dewatering by pressing.

In a manner known in the prior art, attempts have been made to intensify the dewatering of the paper web by raising the temperature of the web passing to the pressing, and of the water contained in this web, e.g., by means of steam boxes and by thereby lowering the viscosity of the water and changing the elastic properties of the web, so that the dewatering in normal roll nips or in so-called extended nips is intensified. It has not always been possible by these means to obtain a sufficient increase in the dry solids content. Rather, even a significant proportion of the so-called free water in the web, which is not immobilized on the fiber material by hydrogen bonds, has had to be removed from the web by evaporation.

So-called closed press sections are commonly used in a paper machine, in which one press nip or, as a rule, several press nips are formed in connection with the central roll. An example of such a prior art press section is the press section marketed by Valmet under the trademark "Sym-Press II", having a smooth-faced central roll with a diameter larger than the diameters of the other press rolls and usually made of rock, as a rule of granite. Granite is quite questionable in machine construction since it is an inhomogeneous natural material of low tensile strength. If it is desired to heat a granite roll, then the deformations dependent upon temperature are non-linear and difficult to predict. As press roll material, granite has relatively good properties for detaching the web, which is at least one of the reasons for its popularity. The detaching properties however, could be better, in particular with respect to unbleached paper qualities.

In a manner known in the prior art, the web is detached as an open, unsupported draw from a face of a central roll in the press. This open draw is quite critical in view of the operation of the paper machine. In this open draw, a difference in speed is used which extends the web, resulting in certain drawbacks. Moreover, this open draw forms a web which is susceptible to breaks in a paper machine.

With increasing production rates of paper machines, the dewatering performed as nip pressing has become a bottleneck which limits the increasing of the running speeds. This comes from the fact that the press nips formed by a pair of rolls have a short area, so that with high speeds the time of residence of the web in these press nips remains short. Especially due to the flow resistance of the fiber structure of the web, the water, however, requires a certain time in order to be removed from the web into the hollow face of the roll or into the press fabric.

If attempts are made to increase the dewatering capacity in nip presses by increasing the nip pressure, with a certain linear load the limit is reached at which an increased nip pressure is no longer helpful, since the structure of the web no longer endures the compression.

In the prior art, so-called hot-pressing methods are also known, in which respect, by way of example, reference is made to U.S. Pat. No. 4,324,613, according to which the paper web is pressed in a roll nip in which one of the rolls or cylinders has been heated by means of surface heating to a temperature higher than 100° C.

In this nip, the surface water in the paper web can be vaporized. The pressurized vapor blows water which has been pressed into the intermediate spaces in the fibre structure in the paper, into the press felt. The dry solids content achieved by means of this prior art, hot-pressing method is quite good, but a problem is the short nip time in a high speed machine, because the compression time in a roll nip is only about 1 . . . 3 ms, whereby the vaporization does not have enough time to begin properly, unless the roll temperature is very high (of an order of 500° C.). The high temperature of the roll results in problems, in particular with respect to the strength of the press fabric and the roll.

The press treatment and the press device in accordance with the method of the present invention can be applied both to dewatering-pressing of a paper or board web and to calendering of a web, and in particular to so-called gradient calendering. With respect to calender applications of the present invention, reference is made, by way of example, to the Valmet U.S. Pat. Nos. 4,614,565; 4,631,794; and 4,653,395.

With respect to the recent inventions of Valmet connected with the press treatment of web and closely related to the present invention, reference is made, by way of example, to FI Patent Applications Nos. 871870; 870309; and 874136.

The present invention is also closely related to conductive heating of a paper web and of a press roll, reference being made in this respect to earlier inventions of Valmet connected with these applications, namely to the FI Patent Applications Nos. 870308 and 870309.

As is apparent from the above, it is known in the prior art to heat the face of a press roll or cylinder so as to provide so-called hot pressing or impulse drying, or to provide detaching of the web. An advantageous prior art mode of heating a press roll or a calender roll is external inductive heating free of contact, in connection with which, as a rule, ferromagnetic roll coatings have been used, even though ferromagnetism is not a necessity in inductive heating. Rather, electrical conductivity of the roll face in view of the heating eddy currents is what is expressly necessary.

It can be ascertained that a number of different properties are required from a roll or cylinder face to be heated, and the provision of such properties in one and the same roll face has not been solved in a satisfactory manner in the prior art. A problem has been how to provide a press-roll coating and equipment for heating the same by means of which it is possible to heat the roll face instantaneously, e.g., to about 350° C. and/or to provide a sufficiently high thermal flow from the roll to the web to be heated and, at the same time, to obtain satisfactory properties of wear, thermal shock, and web detaching from the roll face. A further problem is how to permit crown-variation of a press roll in the same connection.

Induction heaters operating at a high frquency (e.g. 25 kHz) are highly expensive to construct, because of the power transistor technology required by the same.

Impulse drying requires a power transfer capacity of about 0.5 MW/m, as well as regulation of the temperature profile from a heat roll. Faces hotter than what is necessary in view of the process, ought to be avoided even in view of the fire risk alone.

A common prior art mode of solving the above problems is to pass hot gas into the interior of a press roll or calender roll. In such a case, the temperature of the inner face of the roll must be about 700° C., whereby the rigidity of the roll material is no longer sufficient and crown variation cannot be effected by means of the present-day technology.

If a press roll is heated from outside by means of infrared equipment or by means of combustion gases, this would require very high temperatures which cause high heat losses and a clear risk of fire. In a manner known in the prior art, induction heating can also be applied directly to the face of an ordinary press roll made of a ferromagnetic material, but in such a case a higher frequency, i.e. technology of higher cost, is required.

The term "press roll" as used hereinabove, means both a roll of a wet press (including a roll used in impulse drying), a calender roll, and also any other, corresponding roll in a paper finishing device.

SUMMARY OF THE INVENTION

Accordingly, it is a general object of the present invention to provide new solutions to the problems described above.

It is a particular object of the present invention to provide a method and a roll device which are applicable either to impulse drying or to dewatering-pressing taking place in conventional roll nips and/or extended nips, to detaching of a web from a central roll, and to calendering of a paper web.

It is another object of the present invention to improve heating of a roll, e.g. in a paper or board manufacturing machine.

These and other objects are attained by the present invention which is directed to a method for heating an outer face of a cylinder or roll for direct contact with a web pressed thereagainst, which comprises the steps of inductively heating the outer cylinder or roll face from outside a mantle of the cylinder or roll by using a magnetic field, whereby a heating effect based upon eddy currents is produced in an outer layer of the cylinder or roll, providing as the outer layer a relatively thin outer layer of electrically conductive ceramic material, whereby the resistive heating effect is concentrated in the outer layer, restricting depth of penetration of the heating effect in a radial direction of the cylinder or roll to be heated to a sufficiently low depth by at least one of the steps of choosing thickness of the ceramic outer layer and choosing electical frequency of the induction heating, and choosing the ceramic material of the outer layer so that the cylinder or roll face has necessary strength properties both in view of wear resistance and in view of thermal shock of the heating effect. The method may be used in a machine for manufacturing paper or board.

Also, the present invention is directed to an arrangement for heating an outer face of a cylinder or roll, in which the cylinder or roll has a mantle including an outer layer of electrically conductive ceramic material, and at least one inductive heating device being positioned to inductively heat the outer layer from outside of the cylinder or roll. Preferably, the mantle primarily consists of the outer layer. The cylinder or roll preferably forms at least one roll or extended nip.

Therefore, in view of achieving the objects stated above and those which will become apparent below, the method of the present invention is principally characterized by:

the cylinder or roll face being heated from outside the mantle and inductively by using a magnetic field, by means of which a heating effect based upon eddy currents is produced in the outer layer of the roll;

as the cylinder or roll face, a relatively thin outer layer of an electrically conductive ceramic material being used, in which the resistive heating effect is concentrated;

the depth of penetration of the heating effect in the radial direction of the roll to be heated being restricted to a sufficiently low depth by means of the choice of the thickness of the ceramic outer layer and/or of the electric frequency of the induction heating; and besides its electrical properties, the ceramic material of the outer layer being chosen so that the cylinder or roll face is given the necessary properties of strength, both in view of the wear resistance and in view of the thermal shock of the heating effect.

On the other hand, the device in accordance with the present invention is principally characterized by comprising a combination of:

such a cylinder or roll which can be heated having a cylinder mantle consisting primarily of an outer layer of an electrically conductive ceramic material; and one or several inductive heating apparatus fitted in connection with the cylinder or roll, said heating apparatus heating from outside said outer layer substantially composed of the electrically conductive ceramic material.

When the present invention is applied to impulse drying, due to the present invention the thermal energy can be advantageously applied to the relatively thin outer mantle face made of an electrically conductive ceramic material, of the heating cylinder or roll. By means of a setting of the penetration depth, based on the choice of the thickness of the ceramic face and of an underlying insulation layer, if any, and/or of the frequency of the inductive heating, the heating depth can be made such that the thermal energy passed to the induction apparatus has time to be transferred into the web in the nips. Due to the invention, heat losses and risk of fire can also be made considerably lower than, e.g., by means of infrared heating.

The electrically conductive ceramic material used as the roll coating in the present invention, can be chosen so that it endures the thermal shocks and the mechanical wear, and by its means a suitable detaching of the web from the roll face can be obtained, which are particularly important properties especially when the invention is applied in dewatering presses in which the web is detached from a central roll thereof as an open draw.

The advantages of the method and the device of the present invention are likely to be best utilized in connection with impulse drying, whereby, in induction heating, due to the present invention it is possible to use a relatively low frequency, e.g. about 300 . . . 1000 Hz.

An advantageous device in accordance with the present invention heats the face of a press roll by means of electromagnetic induction, to about 350° C., the heat being transferred by the face to the web. The heating depth is determined as equal to the thickness of the layer of the electrically conductive ceramic material applied in the invention, in which case the heating frequency can be chosen more freely. The frequency is, however, preferably higher than 500 Hz in order that a uniform heating result is obtained in the direction of rotation of the roll. In such a case, in the coating structure of the press roll, there is an electrically insulating layer below the electrically conductive ceramic outer mantle. This electrically insulating layer is also thermally insulating, which permits a sufficiently low flow of heat into the roll, whereby it is possible to use variable-crown roll construction.

In particular, the device in accordance with the present invention is characterized by an inductive heating device comprising a number of ferritic magnetic cores which are placed side-by-side in an axial direction of the cylinder or roll to be heated. The component cores are heated either by means of a common coil or by means of a separate coil heating each of the individual component cores. An electric power of invariable or adjustable frequency is pased to the coil or coils. A basic level of the heating effect and/or the distribution of the heating effect in the axial direction of the cylinder or roll, are/is regulated by altering the frequency of the electricity supplied to the coil or coils, and/or by adjusting an air gap between front faces of the component cores and the roll face to be heated.

Regulation of the transfers property profile of the web can be accomplished by regulating the distance of the ferrite cores that control the magnetic field from the roll (air-gap regulation).

In the present method, the roll face is preferably heated to a temperature that is within the range of about 140°−500° C.

In the invention, as the outer coating of a press roll or cylinder, such an electrically conductive ceramic material is used having a specific resistance lower than about $10^{-2}$ Ωm, preferably within the range of about 2 . . . $8\times10^{-5}$ Ωcm. The wear properties of the ceramic material used in the present invention are considerably better than those of structural metals, which is true in the case of ceramics in general. The resistance of a ceramic face to thermal shocks is also considerably better than that of metals.

As the electrically conductive ceramic material of the outer layer, boride ceramics are preferably used, which are most appropriately based on diborides of titanium and zirconium.

According to the invention, it is possible to achieve an induction heating arrangement which has good efficiency, while the embodiments of equipment can be made of relatively small size and advantageous even in other respects. Another advantageous form of application of the invention herein, is the so-called gradient calendering, in which respect reference is made to the Valmet FI Patent No. 71,374 (corresponding to U.S. Pat. No. 4,653,395).

BRIEF DESCRIPTION OF THE DRAWINGS

The present invention will be described in greater detail below with reference to certain exemplary embodiments thereof illustrated in the accompanying figures, and to which, however, the present invention is by no means intended to be strictly confined. In the drawings, FIG. 1 is a schematic illustration of a prior-art closed press section including an induction apparatus making use of the method of the present invention, as well as a central roll of the press;

FIG. 1A is an enlarged, cross-sectional view of a press roll provided with a coating in accordance with the present invention, and of a magnetic-shoe device operating in connection therewith;

DESCRIPTION OF THE PREFERRED EMBODIMENTS

Figure 2:
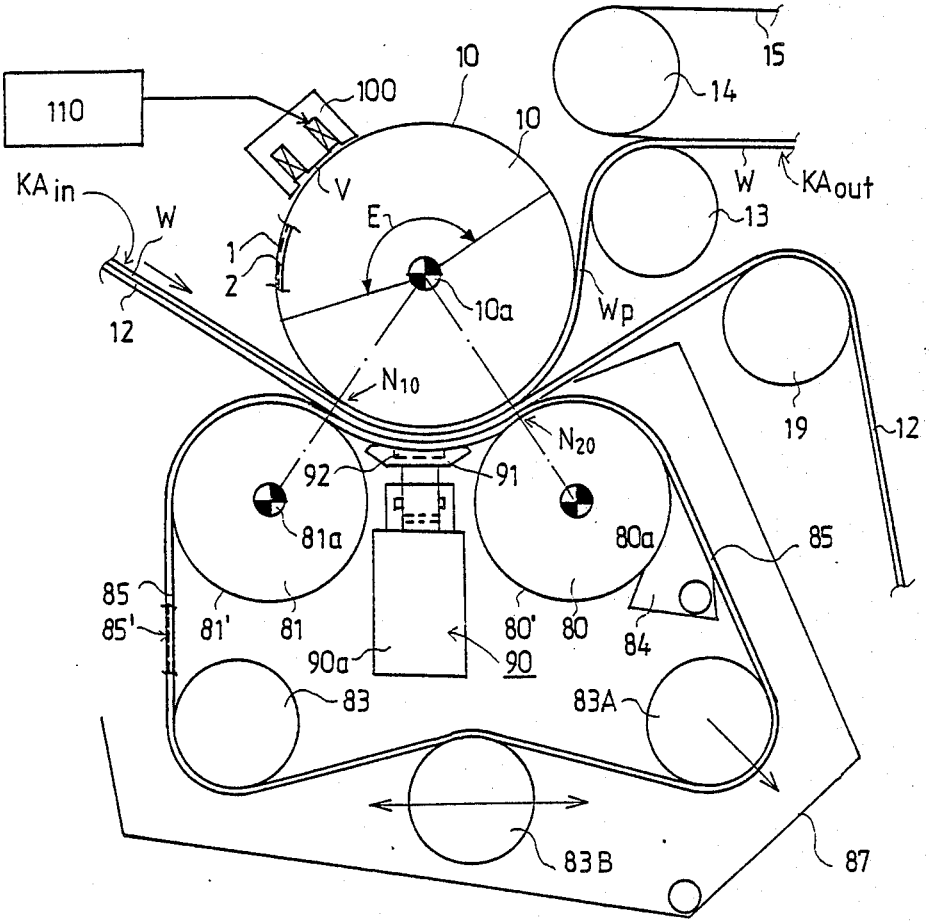
FIG. 2 illustrates the induction heating and a hot cylinder in accordance with the present invention, as applied to an impulse drying device.

FIG. 1 is a schematic side view of a "Sym-Press II" (TM) press section of Valmet, wherein the method and a press roll 10 in accordance with the present invention are applied. To begin with, as a background of the present invention, the prior-art general construction of the press section illustrated in FIG. 1 will be described. A paper web W is drained on a forming wire 50 of a paper machine, from which the web W is detached on a downwardly inclined run of the wire 50 between guide rolls 51 and 52 and a detaching point P, then being transferred on a suction zone **53*a* of a pick-roll 53 onto a pick-up felt 55**, on whose lower face the web W is transferred into a first dewatering press nip $N_1$.

The first nip $N_1$ is formed between a press-suction roll 54 and a hollow-faced 57 lower press roll 56. Two felts pass through the nip $N_1$, i.e. the lower felt 60 guided by the guide rolls 58 and 59 and the pick-up felt 55 which acts as the upper felt in the first nip $N_1$. After the first nip $N_1$, the web W follows by the effect of the suction zone **54*a* of the press-suction roll 54, the upper roll 54 and runs into the second dewatering press nip $N_2$ which is formed between the press-suction roll 54 and a smooth-faced 10' central roll 10** in accordance with the present invention.

The diameter $D_1$ of the central roll is substantially larger than diameters of the other press rolls 54, 56, 61. This is why there is enough space for various devices to be fitted around the central roll 10, including the inductive heating device 100 in accordance with the present invention. On the section sector 54a of the suction roll 54, there is a steam box 71 which acts upon an outer face of the web W and raises the temperature of the web W and of the water contained therein, while lowering the viscosity of the water.

Substantially at the opposite side of the central roll 10 relative to the second nip $N_2$, there is a third dewatering press nip $N_3$ through which the press felt 65 runs, being guided by guide rolls 63 and 64. The rolls of this nip $N_3$ are the central roll 10 and a hollow-faced 62 press roll 61.

The adhesion properties of the smooth face 10' of the central roll 10 are such that after the second nip $N_2$, the web follows the face 10, of the central roll 10. On the lower free sector of the central roll 10, there is a doctor 69, which keeps the roll face 10' clean and detaches any paper web passing from the roll face 10'.

From the face 10' of the central roll 10, the web is detached at a detaching point R as an open draw $W_0$, being transferred onto a drying wire 70 having a loop which has been brought to a distance as short as possible from the face 10' of the roll 10, and being guided by a guide roll 66. After the guide roll 66, suction boxes 67 are provided inside the loop of the drying wire 70, the suction boxes ensuring that the web W adheres to the drying wire 70 and is reliably transferred to the drying section, whose first drying cylinder or corresponding lead-in cylinder is denoted by reference numeral 68.

According to FIG. 1, an induction heating device 100 in accordance with the present invention is fitted between the nips $N_2$ and $N_3$, which supplies heating power through the air gap V by means of a magnetic field into the particular outer layer 3 provided on the roll 10 in accordance with the present invention. In FIG. 1, the regulating devices and the devices for the supply of electric power in the induction heating device 100 are schematically illustrated as the block 110.

Moreover, a second induction heating device 100' is illustrated in FIG. 1, to be used in the area of the web W detaching point R, the purpose and operation of this device 100' being described in greater detail below.

In the following, with reference to FIG. 1A, the construction of the roll 10 which has a particular outer layer in accordance with the present invention, will be described. The roll 10 comprises a frame mantle 1 of, e.g., cast iron, which gives the roll the necessary basic strength. If necessary, crown variation devices (not illustrated) may be provided in the interior of the roll mantle 1. Onto the outer face of the mantle 1, a ceramic inner layer 2 has been applied, which acts as a thermal insulator and as an electric insulator. On the insulation layer 2, there is an electrically conductive ceramic outer layer 3 whose outer face constitutes the outer face 10' of the roll 10. This outer face 10' is sufficiently smooth and has adhesion properties suitable for the web W. The thickness of the frame mantle 1 is, as a rule, within the range of $s_1$= about 60 . . . 140 mm. The thickness $s_2$ of the insulation layer 2 is, as a rule, within the range of $s_2$= about 3 . . . 10 mm, preferably $s_2$= about 4 . . . 5 mm. The thickness $s_3$ of the outer layer 3 is, as a rule, within the range of $s_3$= about 0.1 . . . 3 mm, preferably $s_3$=0.1 . . . 0.5 mm.

According to FIG. 1A, the proximity to of the electrically conductive ceramic outer layer 3 of the roll 10, a magnetic-shoe device is arranged as an induction heating device 100, this device extending substantially across the entire length of the roll 10. In a manner that will become apparent below, the magnetic-shoe device is formed of several ferritic magnetic cores 20 placed side-by-side, said cores applying a magnetic flux through air gaps V to the electrically conductive outer layer 3. The magnetomotoric force is generated by means of the coils 30, to which an adjustable power is fed which is obtained from control and electric devices 110.

In accompanying Table 1, data are given on electrically conductive composite ceramics suitable for use as materials for the outer layer 3 of the roll 10. The qualities 1, 2 and 3 given in Table 1 are boride ceramics, which are based on diborides of titanium and zirconium. The specific resistance of the qualities 1 and 2 is particularly suitable for use in the present invention, whereas the specific resistance of the quality 3 is so high that it is not heated sufficiently well in all applications of the invention.

In a preferred embodiment of the present invention, underneath the electrically conductive thin ceramic layer 3, a layer 2 is used which acts as an electrical and thermal insulation and which is made, e.g., of the ceramic XG manufactured by Yamaguchi.

The insulation layer 2 confines the inductive heating effect to the electrically conductive outer layer 3 alone. Moreover, the insulation layer 2 restricts the flow of heat from the outer layer 3 to the metal mantle 1 so that the temperature of the metal mantle remains at a sufficiently low level, among other factors, in view of other equipment placed inside the mantle, e.g. crown variation means.

In FIG. 1, in addition to the device 100, a second conduction heating device 100, is also used in the area of the detaching point R of the web W. This device 100' is supplied with electricity whose frequency f is, e.g., f= about 500 Hz. This means that the temperature of the roll face 10' rises in the detaching area R, e.g., by about 50° C. If the basic temperture of the roll is maintained at about 70° C., by the effect of the additional heating by the device 100' in the detaching area R, the temperature of the face 10' locally rises to about 120° C. Thereby, the water layer present between the web W and the roll face 10' is at least partially vaporized and forms a thin vapor film which cannot keep the web W in contact with the roll face 10'. Rather, the web W is detached from the roll face and can be passed directly to the drying section, e.g. onto its drying wire 70.

As is known in the prior art, a certain detaching tension has been necessary in the web W which has been produced by means of a difference in velocity, i.e. a so-called draw difference, between the roll face 10' and the drying wire 70, this difference having extended the web W. Due to the vaporization transfer carried out by means of the device 100', a detaching tension is not necessarily needed so that it is also possible to use a closed draw, for example a draw in which in the case illustrated in FIG. 1 the guide roll 66 has been shifted so that it reaches contact with the roll face 10' and forms a lightly loaded transfer nip with the face 10'.

The embodiment of the invention illustrated in FIG. 1 may also be accomplished so that there is no heating device 100, but rather a detaching-heating device 100' in accordance with the present invention is exclusively used which is fitted in the web W detaching area R. In such a case, a sufficiently high basic temperature of the outer face 10' of the central roll 10 is maintained by other means, e.g by means of a heating medium fed into the interior of the roll 10, or by corresponding other means known in the prior art. The embodiment of the invention in accordance with FIG. 1 may also be carried into effect without a detaching-heating device 100', by means of the heating device 100 and the related electric and control devices 110 alone.

The hot-pressing or impulse drying device illustrated in FIG. 2 comprises a hot cylinder 10 with a relatively large diameter and with a drive gear 10a. Such cylinder 10 has a smooth or porous outer face 10' which consists of an electrically conductive ceramic layer 3 in the manner described above. The cylinder 10 face is heated by means of induction heating devices 100 based on eddy currents through an air gap V.

The temperature $T_0$ of the cylinder 10 face 10' is arranged to be $T_0 > 100°$ C. when the face 10' meets the web W that is being passed to the hot pressing on the face of the press felt 12, the dry solids content of the web W being denoted with $KA_{in}$. Depending on the location of the hot-pressing device in accordance with the present invention in the process, $KA_{in}$ varies within the range $KA_{in}$= about 25 . . . 75%.

The device further includes a press roll 81 situated before the press shoe device 90, this roll 81 having a smooth or patterned mantle face 81' and provided with a drive 81a. The press roll 81 is situated inside the loop of the glide belt 85, and the roll 81 forms a nip $N_{10}$ with the hot cylinder 10. The web W is passed on the support of the press felt 12 directly into the nip $N_{10}$ so that the web W is situated in direct contact with the smooth face 10' of the cylinder 10 which has been inductively heated by means of the device 100. In a corresponding manner, the press felt 12 is detached from the web W after the second nip $N_{20}$, this web W following the smooth face 10' of the cylinder 10 from which it is detached as an open draw $W_p$.

The press shoe device 90 in the hot-pressing device illustrated in FIG. 2 comprises an extended nip press shoe 91, which has a hydrostatic pressure chamber 92 situated facing an impervious glide belt 85. The press shoe device 90 comprises a frame beam 90a which extends across the entire width of the paper web W. A cylinder block is arranged as supported on the frame beam 90a, and the pressure or pressures of a pressure medium can be passed from a pressure source into the pressure space of the cylinder block. The cylinder block is provided with a sealed piston which has a glide face operating against the inner face of the glide belt 85 in the extended-nip zone. Pressure-fluid lubricant is passed out of the pressure space through bores into the hydrostatic pressure chamber 92. Around the loop of the glide belt 85, a spash water collecting trough 87 is provided. The second press roll 80 is provided with a smooth face 80' and with a drive 80a, and at a rear side thereof there is a lubricant collecting trough 84 from which the lubricant is fed by means of a recirculation device.

The second press roll 80 forms the nip $N_{20}$ with the hot cylinder 10, after which the web W follows the smooth face 10' of the cylinder 10 from which it is detached as a draw $W_p$ by means of a guide roll 13 provided with a drive 13a, being transferred onto the support of the drying fabric 15 guided by the guide roll 14. The fabric 15 carries the web W to the drying section, where the dewatering is continued by evaporation.

The dry solids content of the web W after the hot-pressing device is denoted by $KA_{out}$. As a rule, the dry solids content is $KA_{out}$= about 50 . . . 70%.

The paper web is pressed by means of an extended-nip press shoe 91 of relatively low pressure ($p_1$) through a belt 85, and the press felt 12 against the hot ($T_0 > 100°$ C.) cylinder 10 face 10'. The heating of the face of the paper web W that is placed against the roll 10, is achieved to a temperature higher than about 100° C. The temperature of the face 10' when it reaches contact with the web is within the range of $T_0$= about 150° . . . 500° C. The corresponding temperature $T_{ol}$ at the time when the web W is detached from the face 10' is, as a rule, within the range of $T_{ol}$= about 100° . . . 300° C. The pressure level of the extended-nip press shoe 31 is, e.g., $p_1$= about 0.1 . . . 5 MPa.

Figure 2A:
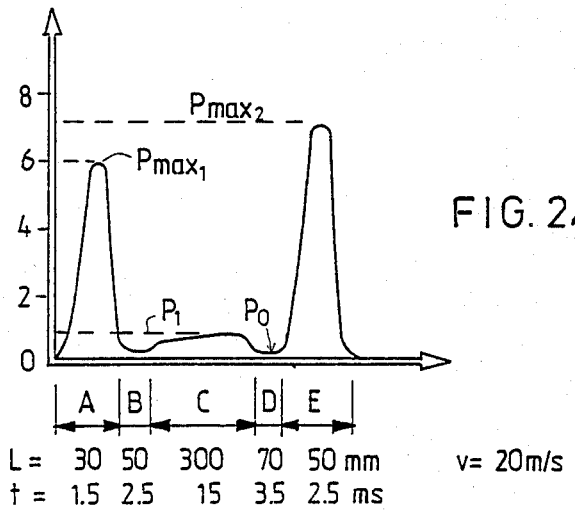
FIG. 2A illustrates distribution of the press load in a device in accordance with FIG. 2.

The extended-nip shoe 91 is hydrostatic, hydrodynamic, or a combination thereof. After the extended nip pressing stage C, the pressure applied to the paper web W is lowered to the level $p_0$ determined by the tension of the belt 85 within the zone D, and the vaporization of the water in the paper web W is intensified by the effect of the lowering of the pressure $p_1 \rightarrow p_0$. The pressure $p_0 = T/R$, wherein T=tensioning strain of the belt 85 and R=radius of the cylinder 10. The zone D is followed by the intensive pressing stage taking place in the nip $N_{20}$, wherein the paper web W is pressed with a high pressure between the cylinder 10 or a corresponding roll and the press roll 80. In FIG. 2A this stage is denoted by E, and the maximum of the compression pressure is, thereat, preferably $p_{max2}$= about 7 MPa. In the pressing stage E, the water vapor is blown through the paper web W and produces blowing off of the water present in the intermediate spaces between its fibers and consequently, an intensify pressing result and a higher dry solids content $KA_{out}$.

As the glide belt 85, it is also possible to use a so-called resilient belt, by means of which the zones A and E of the roll nips $N_{10}$ and $N_{20}$ and, at the same time, their compression times can be extended and the compression impulse increased. If necessary, it is also possible to use a separate resilient band which is guided to run between the glide belt 85 and the felt 12. Since water cannot be pressed out of the press felt into hollow faces of the rolls, it is possible to form a hollow face into the belt 85 which is referred to by the dashed lines 85' of the outside face of the belt 85.

In the stage A illustrated in FIG. 2A, wherein a peak compression pressure $p_{max1}$ is used in the nip $N_{10}$, the first hot-pressing stage is concerned. The stage B is a pressure-lowering stage, the stage C is the second preliminary hot-pressing stage, and the stage D is the pressure-lowering and vapor-formation stage, with the stage E (peak pressure $p_{max2}$) being the (intensive) compression and blowing-through stage proper.

In FIG. 2A, on the middle line (L) below the zone notations A...E, examples are given on advantageous lengths (mm) of the zones and on the lowest line (t) the corresponding dwelling times (ms) when a machine speed of v= about 20 m/s is used.

Figure 3:
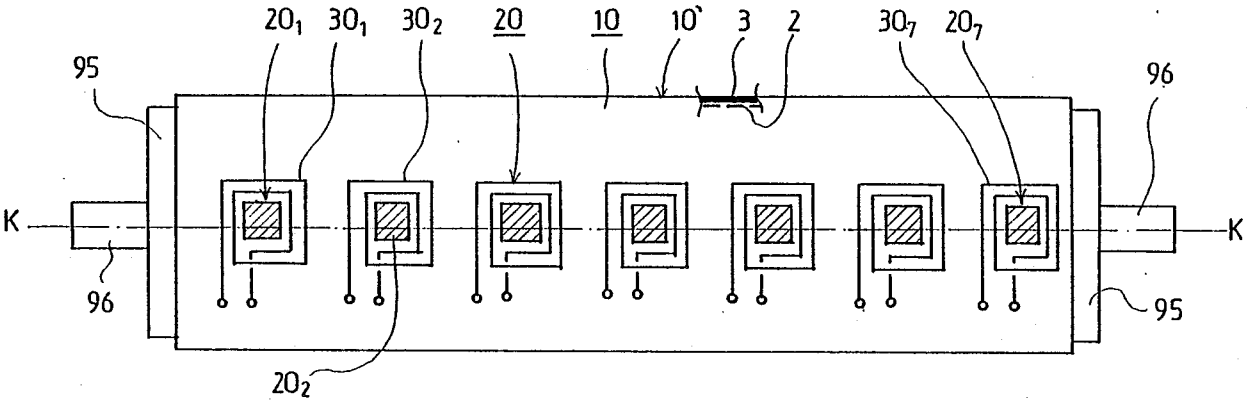
FIG. 3 is a schematic illustration of the principle of an induction heating device intended for application of the present invention, as seen in the machine direction.
Figure 4:
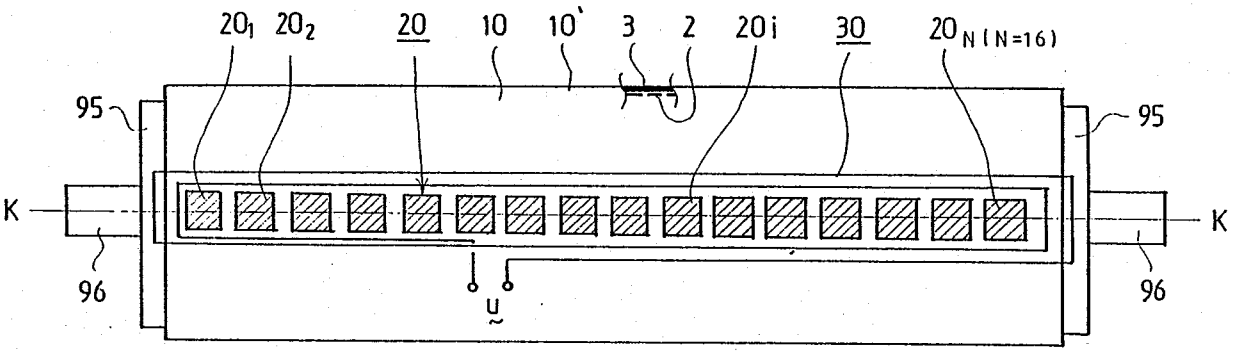
FIG. 4 illustrates a second solution of a principle of an induction heating device in a manner corresponding to FIG. 3.

In accordance with the invention, the press roll 10 illustrated in FIGS. 3 and 4 is provided with an outer mantle 3 of an electrically conductive ceramic material. The roll 10 is journaled to revolve around its central axis K—K through its ends 95 and axle journals 96. Bearings are provided on the axle journal 96 which are fitted in bearing housings. The bearing housings are fixed to the rolls support frame which is supported on a base.

In the interior space of the roll 10, it is possible to fit crown variation or crown adjustment devices known in and of themselves, for which an abundant space is provided, because it is not necessary to use heating devices inside the roll 10 operating by means of a liquid medium or equivalent. Such heating devices, however, are not completely excluded from use in conjunction with the present invention herein.

According to the invention, the roll 10 is arranged to be heated inductively and electromagnetically by means of eddy currents, so that by the effect of this heating, the temperature of the thin surface layer 3 of the roll 10 made of an electrically conductive ceramic material is raised to a remarkably high level, as a rule about 100° . . . 350° C. In view of effecting the inductive local heating, and the proximity of the roll 10, in the same horizontal line with each other in the axial direction of the roll, component cores $20_1$, $20_2$ . . . $20_N$ of a ferrite core 20 are arranged. These component cores $20_n$ constitute the heating device 100, which further includes a magnetizing coil 30 or a component coil $30_1$ . . . $30_N$ of its own for each component core (FIG. 3). The inductive heating is carried out free of contact so that a little air gap V remains between the ferrite cores $20_n$ and the roll 10 face 10'. Through this air gap V, the magnetic fluxes of the ferrite cores $20_n$ are closed through the electrically conductive ceramic layer 3 of the roll 10, producing therein a heating effect in the eddy currents.

In FIG. 3, each component core $20_1$ . . . $20_N$ is illustrated as having a magnetizing coil $30_1$ . . . $30_7$ of its own. An alternative embodiment of the invention is similar to that illustrated in FIG. 4, in which all the component cores $20_1$ . . . $20_N$ (N=16) have a common magnetizing coil 30 which is, according to FIG. 4, provided with two turns. According to FIG. 7, the magnetizing coil 30 of the iron core 20 has only one turn.

According to an alternative embodiment of the invention, each component core $20_n$ is separately arranged to be displaceable in the radial plane of the roll 10 so as to adjust the magnitude of the active air gap V and, at the same time, the basic level and/or the distribution of the heating effect. For this purpose, each component core $20_n$ is attached to the frame by means of an articulated joint. The displacing of the component cores $20_n$ can be arranged by means of different mechanisms. As a rule, the air gaps V may vary, e.g., within the range of about 1 . . . 100 mm. With respect to the mechanical means for the adjustment of the air gaps, whose construction is not described in this connection, reference is made to FIG. 9 as well as to the Valmet FI Patent Application No. 833589, which was mentioned above.

With respect to the electrotechnical background of the present invention, the following is ascertained.

When the electrically conductive ceramic layer 3 of the roll 10 or cylinder is provided with a variable magnetic field as is well known, losses of eddy currents and hysteresis are produced in the material and the material is heated. The power (P) of the eddy currents depends on the strength (B) of the magnetic field and on the frequency (f) of variation of the magnetic field as follows:

$$P \approx B^2 \cdot f^2 \qquad (1)$$

The variable magnetic field in the ceramic layer 3 of the roll 10 is closed through the front faces of the ferrite cores 20 of the device 10 and the air gaps V. This magnetic field induces eddy currents in the ceramic layer 3 of the roll mantle 10, these currents producing heat due to the relatively high resistance (see Table 1) of the layer. The distribution of the eddy currents induced in the ceramic layer 3 in the direction x of the radius of the roll 10 follows the law $$I_x = I_o e^{-x/\oplus} \qquad (2)$$

wherein $I_x$ is a current density at the depth x from the mantle face 10', $I_o$ is the current density at the mantle 10 face 10', and $\oplus$ is the depth of penetration. The depth of penetration has been defined as the depth at which the current density has been lowered to b 1/e of the current density $I_0$ at the surface. For depth of penetration, the following equation is obtained:

$$\delta = \frac{1}{2\pi} \sqrt{\frac{10^7}{f} \frac{\rho}{\mu} \frac{m}{\eta s}} \qquad (3)$$

$\rho$ is the specific resistance of the ceramic material in the layer 3 (see Table 1), f is the frequency of the magnetizing current, and, $\mu$ is the relative permeability of the ceramic material in the outer layer 3.

The equation (3) indicates that, when the frequency becomes higher, the depth of penetration becomes lower.

In the invention, heating powers are used, as a rule, that are of an order, in impulse drying, of about 10 MW, in gradient calendering of about 500 kW, and in web detaching of about 100 kW. As is known, the smaller the air gap V, the larger the proportion of the electric power passed to the device through the coil 30 that is transferred to the ceramic layer 3 on the roll 10 to be heated.

Figure 6:
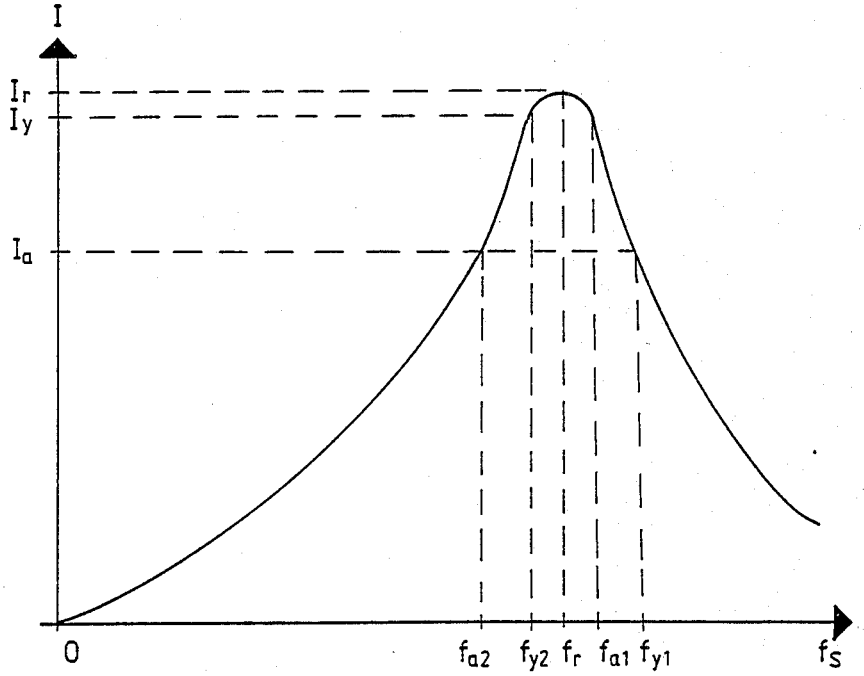
FIG. 6 is a graphic illustration of the current in an induction heating coil or coils in resonance as a function of frequency.
Figure 7:
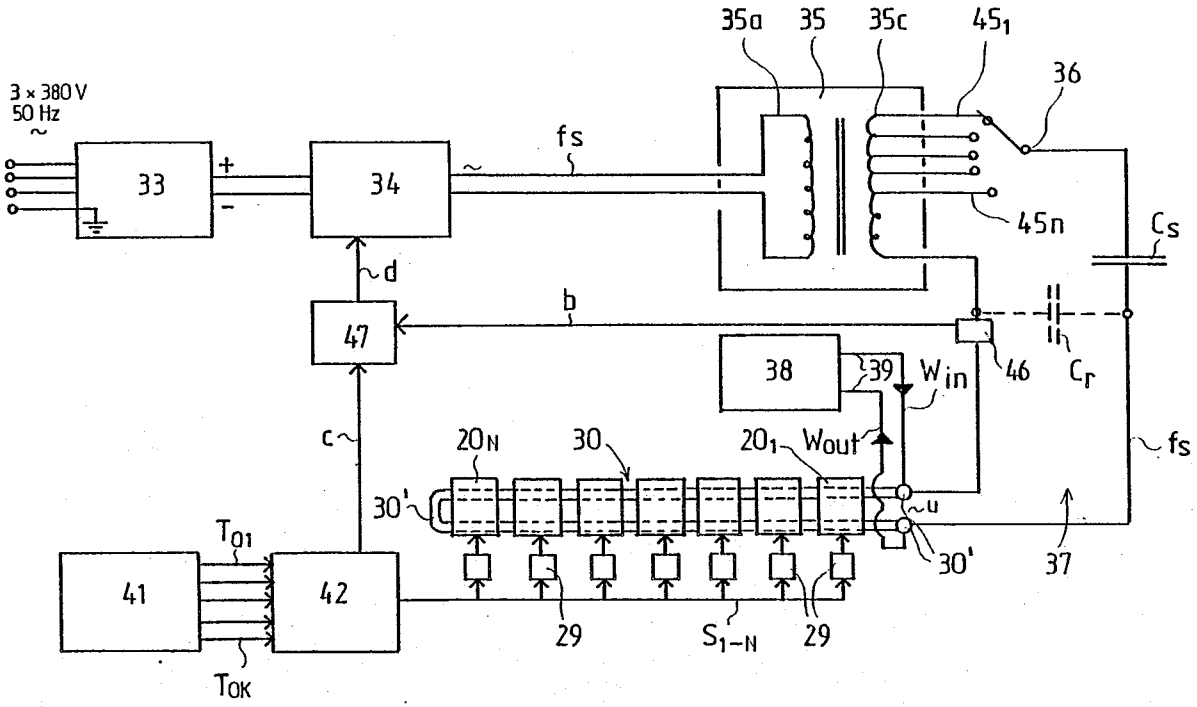
FIG. 7 is a block diagram illustration corresponding to FIG. 5, of a second exemplary embodiment of an induction heating device.

According to FIG. 7, the electric power that supplies the induction coil 30 is taken from a 50 Hz three-phase network (3×380 V). By means of a rectifier 33, the AC current is converted to DC current, which is, by means of an inverter in itself known, based on power electronics, converted either to constant-frequency or variable-frequency ($f_s$) AC electricity. The regulation of the positions of the component cores $20_1$ . . . $20_N$ of the ferrite core 20 can be arranged, e.g., by means of the automatic closed regulation systems shown in FIGS. 5 and 6. The regulation motors are stepping motors 29, which receive their control signals $S_{1 \ldots N}$ from the regulation system 42. The regulation system 42 is controlled by a detector device 41 which is, e.g., a temperature measurement device, by means of which the factual values of the surface temperatures $T_{01}$ . . . $T_{0k}$ of the roll are measured at several points on the roll 10 in the axial direction K—K of the roll. The regulation system 42 includes a set-value unit, by means of which the axial K—K temperature profile of the roll can be optimally set.

The power of the inverter 34 is fed through a matching transformer 35 to an LC-resonance circuit in accordance with the invention, the effect and operation of this circuit being illustrated in FIG. 6. In a manner known in and of itself, the transformer 35 comprises a primary circuit **35*a*, a core 35*b*, and a secondary circuit 35*c*. The secondary circuit has n pcs. of taps $45_1$ . . . $45_n$, which can be connected through a change over switch 36 to the resonance circuit 37 by means of which the power is fed to the induction coil 30**. Naturally, as is well known, the resonance frequency of a connected RLC-circuit can be calculated from the formula $$f_r = \frac{1}{2\pi\sqrt{LC}} \quad (4)$$

Figure 5:
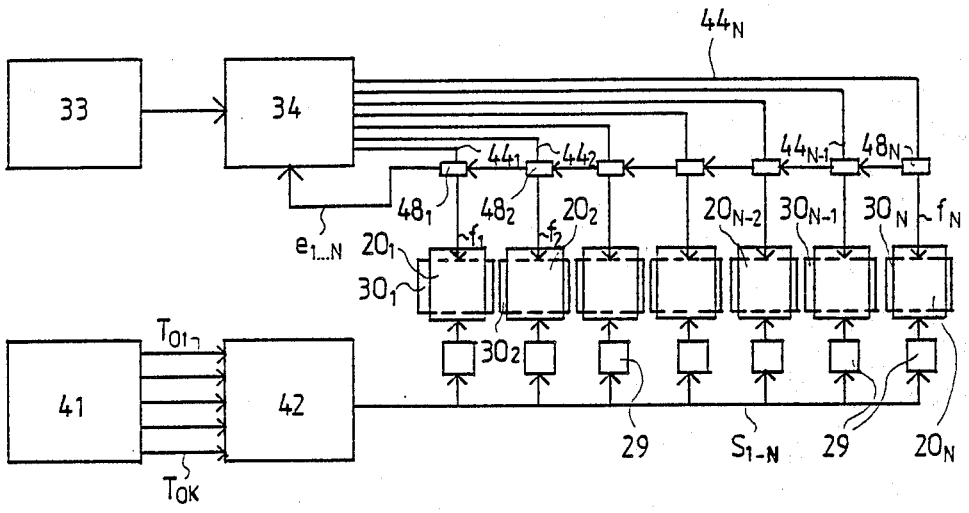
FIG. 5 is a block diagram illustrating a first exemplary embodiment of an induction heating device.

In FIG. 6, the dependence of the current I in the circuit 37 from the frequency $f_s$ is illustrated. In resonance, the current $I_r = U/R$, wherein R is the resistance of the circuit 37. In FIG. 5, it is assumed that the voltage U is invariable.

The efficiency of the transfer of heating power is at the optimum when the operation takes place at the resonance frequency $f_r$. However, for a number of reasons, it is not optimal to operate at the resonance frequency $f_r$ and/or at the same time at both sides of the same. Rather, the frequency of operation is chosen within the area $f_{a1} \ldots f_{y1}$ above the resonance frequency $f_r$ or, in a corresponding manner, within the area $f_{a2} \ldots f_{y2}$ below the resonance frequency $f_r$. Within the scope of the invention, the frequency ranges are preferably chosen as follows:

$$f_{a1} \ldots f_{y1} = \text{about } (1.01 \ldots 1.15) \times f_r \text{ or } f_{a2} \ldots f_{y2} = \text{about } (0.85 \ldots 0.99) \times f_r.$$

According to FIG. 7, in the RLC-circuit, a series capacitor $C_s$ is used. The basic tuning of the circuit 37 is carried out so that the transmission ratio of the transformer 35 is chosen by means of the switch 36 so that the resonance frequency $f_r$ calculated from the formula (4) becomes placed at the correct position in accordance with the principles explained above.

In FIG. 7, a parallel capacitor $C_r$ is illustrated by dashed lines. This capacitor can be used instead of, or at the side of, the series capacitor $C_s$. As is well-known, the resonance frequency $f_r$ in a parallel resonance circuit whose induction coil (L) has a resistance R, is calculated as follows:

$$f_r = \frac{1}{2\pi\sqrt{LC}} \sqrt{1 - \frac{R^2C}{L}} \quad (5)$$

The above equation (5) has a coefficient dependent upon the resistance R.

From the point of view of the objectives of the present invention, a series-resonance circuit is, however, as a rule, preferable in particular in view of adjustment and control.

Within the scope of the present invention, the resonance frequency is, as a rule, chosen within the range of $f_r$= about 200 Hz to 30 kHz. The frequency range $f_r$= about 200 to 400 Hz is estimated to be particularly advantageous.

To maintain the efficiency of the power supply, and to eliminate the phenomena of instability i.e., the "risk of runaway", the operating frequency $f_s$ is automatically adjusted in accordance with the impedance of the resonance circuit 37 so that the operating frequency $f_s$ remains near the resonance frequency $f_r$ but yet, at a safe distance from the same in view of the risk of runaway, i.e. in the areas $f_{y1} \ldots f_{a1}$ or $f_{y2} \ldots f_{a2}$ illustrated in FIG. 6.

The measurement of the impedance of the resonance circuit 37 may be based, e.g., on measurement of the current I that flows in the circuit. This mode of measurement is illustrated in FIG. 7 by the block 46, from which the regulating signal b is controlled to the regulating unit 47, which alters the frequency $f_s$ of the frequency converter 34 on the basis of the regulating signal b. Another mode of measurement of the impedence which may be used as an alternative or in addition to the current measurement, is to pass a regulating signal c from the block 42, from which information can be obtained concerning the positions of the component cores $\mathbf{20}_n$, i.e. the air gaps V which primarily determine the impedence by acting upon the inductance L. An alternative mode of regulation is to pass a return signal from the stepping motors 29 and the block 47 and further, so as to act upon the output frequency $f_s$ of the frequency converter 34.

FIG. 5 illustrates an alternative embodiment of the invention, in which each component core $\mathbf{20}_n$ is provided with an induction coil of its own, in accordance with FIG. 3. Into each component core $\mathbf{20}_n$, a separately adjustable frequency $f_1 \ldots f_N$ of its own is passed from the frequency converter 34 by means of the supply wires $\mathbf{44}_1 \ldots \mathbf{44}_N$. Now, when the air gap V of each component core 20 is adjusted by means of the stepping motors 29, the resonance frequency $f_r$ of each separate resonance circuit is altered. The measurement of the impedence of each separate resonance circuit is carried out by means of separate current meters $\mathbf{48}_1 \ldots \mathbf{48}_N$, the frequency converter unit 34 or group being controlled by means of the series of signals $e_1 \ldots e_N$ received from the current meters. These signals contain the data concerning, e.g., the air gaps V of the different component cores. Thereat, each frequency $f_1 \ldots f_N$ can be optimized in view of the efficiency of the power supply of each component core and in view of the stability of the regulation. In view of obtaining a sufficiently low depth of penetration, the frequency $f_1 \ldots f_N$ are, e.g., within the range of 0.3 to 1.0 kHz.

Figure 8:
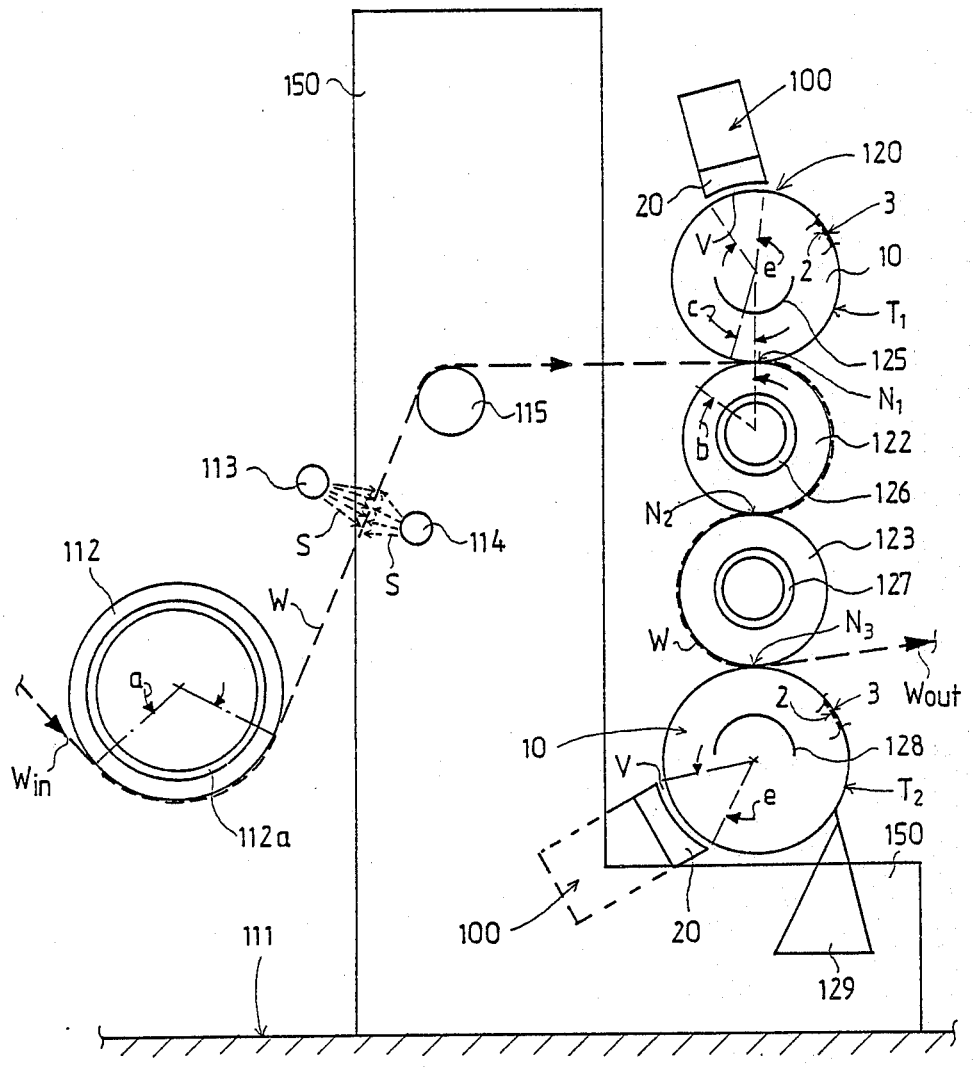
FIG. 8 illustrates application of the method and device of the present invention in a gradient calendar.

The calender in accordance with FIG. 8 comprises a frame construction 150, which is fixed to a base 111. In connection with the frame construction 150 of the calender, a calender stack 120 is journaled by means of support and loading members (not illustrated). The calender stack comprises, from above, an end roll 10, intermediate rolls 122 and 123, as well as lower end roll 10 in connection with which there is a doctor 129. Both of the end rolls 10 are provided with crown variation or crown adjustment means 125; 128, which are situated inside the roll 10 in the manner known in the prior art and which operate either by means of a pressure medium and/or magnetically. The intermediate rolls 122 and 123 in the calender are most appropriately so-called double mantle heated rolls, whose ends are provided with connector means 126 and 127, by means of which the interior spaces in the intermediate rolls 122, 123 communicate with a heating/cooling aggregate. The cooling/heating medium may be, e.g., circulating water.

Figure 9:
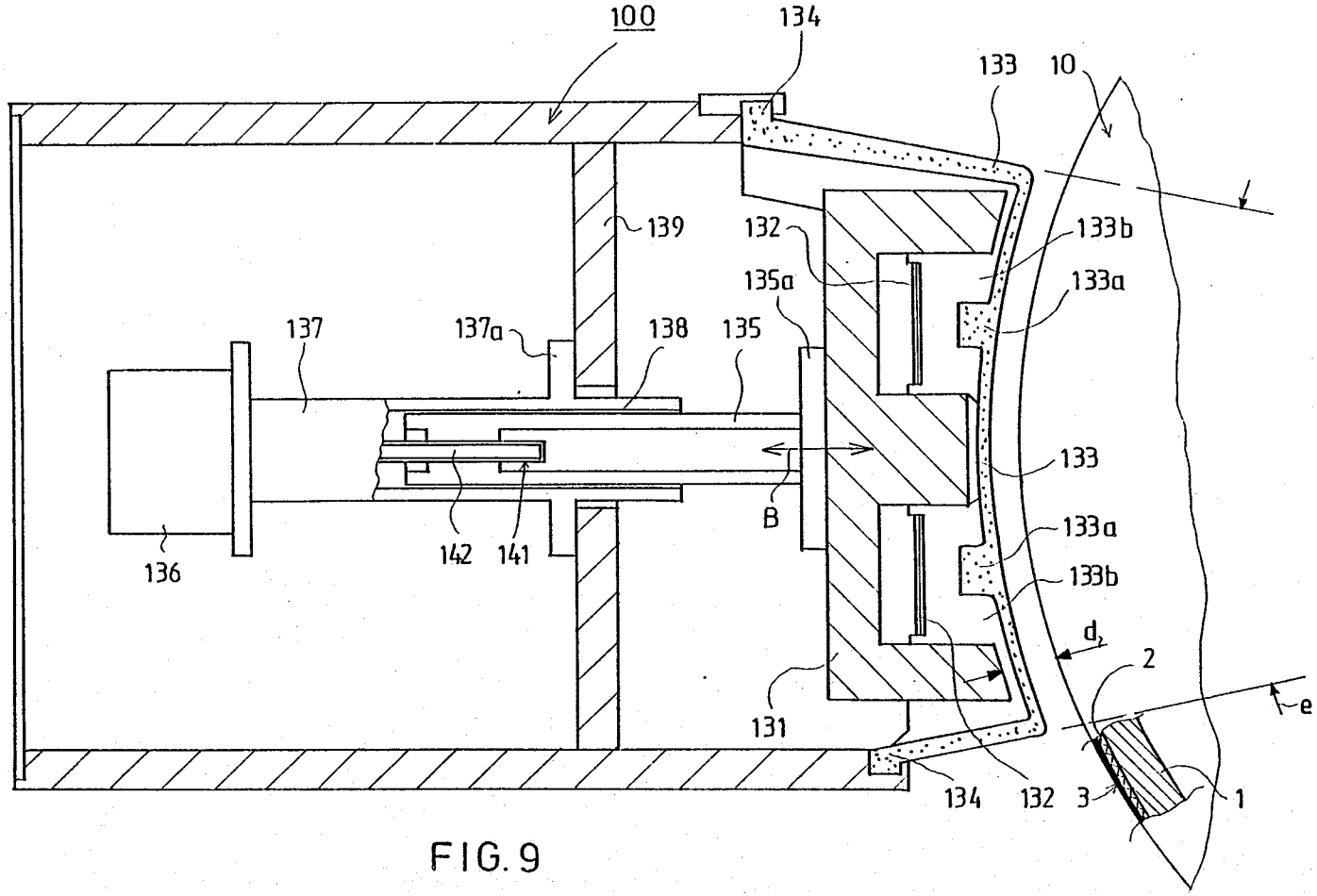
FIG. 9 is a vertical sectional view of a magnetic shoe device in accordance with the present invention, and of a mechanical regulation device used in connection with the same, by means of which regulation device the air gaps of the magnetic shoes, and thereby the heating capacity, can be controlled over an axial direction of the roll.

In accordance with FIG. 8, in connection with the end rolls 10, there are external induction heating devices 100 in accordance with the invention, the details of the construction of these devices 100 being apparent from the above or from FIG. 9. By means of the heating devices 100, through the magnetic shoes 20 provided in the same, a magnetic flux is applied to the outer mantle 3 made of an electrically conductive ceramic material, of the rolls 10 through the air gap V, free of contact, within the sector e, this magnetic flux inducing eddy currents in the outer mantle 3. These eddy currents produce a heating effect due to the resistance of the mantles 3 of the rolls 10.

In FIG. 8, the entering of the web W into the calender, e.g., from the drying section of the paper machine is denoted by reference character $W_{in}$, and the outlet from the calender by reference character $W_{out}$. As is shown in FIG. 1, at the inlet side of the web $W_{in}$, there is a cooling roll 112, with which the web $W_{in}$ is in contact over a sufficiently large sector a. At the ends of the cooling roll 112, there are connecting means 112*a*, by means of which the space between the double mantle of the roll 112 communicates with a cooling water aggregate. The run of the web W between the roll 112 and the first nip $N_1$ is guided by the guide roll 115.

Before the guide roll 115, in connection with the run of the web W, there are moistening devices 113 and 114 at both sides of the web. By means of the devices 113, 114, water jets S are sprayed onto one or both of the faces of the web W to produce a suitable moisture gradient in the direction of thickness of the web. Moistening is not always necessary.

The elevated temperatures $T_1$, $T_2$ equally about 150° . . . 200° C. of the end rolls 10 are produced by means of the induction heating devices 100 described above, by means of which it is also possible to control the temperature profile in the axial direction of the rolls 10. The temperature range $T_2$, $T_3$= about 40° . . . 50° C. of the central rolls 112 and 123 is produced either without any particular operations or, if necessary, by cooling or heating the rolls 122, 123.

An exemplary embodiment of the heating devices 100 used in the present invention will be described below, principally with reference to FIGS. 8 and 9. These devices 100 are placed in conjunction with one or both of the end rolls 10 of a calender and, in certain special applications, if necessary, also in conjunction with the other rolls, i.e. with the intermediate rolls 122, 123. The devices to be described can also be used in the applications illustrated in FIGS. 1 and 2. If necessary, in conjunction with one roll, there may also be several heating devices. The outer mantle of the roll 10 is made of an electrically conductive ceramic layer 3 below which there is preferably an insulation layer 2. In the interior of the rolls 10, there are crown variation or crown adjustment devices known in and of themselves, for which a free space remains because of the external heating device 100, and because it is unnecessary to use heating devices operating with a liquid medium or equivalent in the interior of the roll 10.

The device 30 comprises a number of component cores $131_1$, $131_2$ . . . $131_N$ (N pieces) placed side by side, whose positions can be regulated independently from one another in the direction of the arrow B in FIG. 9, for adjustment of the magnitude d of the active air gap V between the front faces of the cores 31 and the roll 10. The magnitude d of the air gap V is adjustable, e.g., within the range of d= about 10 . . . 60 mm. The component cores 131 have, e.g., a common magnetizing coil, which is supported on the box part 133 by means of projections 133*b*. An adjustable AC current of adequate frequency is supplied into the coil 132.

The position of each component core 131 can be adjusted independently from the other component cores 131, so as to regulate the magnitude d of the air gap V and the axial distribution of the heating effect. For this purpose, the component cores 131 are attached to arms 135 by means of a flange 135*a*. These arms 135 are placed in guide tubes 137 by means of slide fittings 138. Screws 142 are connected to the arms 135 by means of threadings 141, with the screws being operated by screw motors 136.

The screw motors 136 are connected to the regulation system in a manner known in and of itself. By setting the level of the air gaps d of the component cores 131 and/or by setting the level of the magnetizing current of the core 132, it is possible to regulate the temperature level of the rolls 10. By means of individual regulation of the positions of the component cores 131, it is possible to regulate the axial temperature profile and thereby, on the basis of changes in the radius of the roll 10 and in a manner known in and of itself, the nip and the thickness profile of the web W to be calendered.

In front of the front face of the component cores 131, there is a protective box 133 which is attached to the frame part 140 of the heating device 130 by means of a groove-projection fitting 134. The frame part 140 of the heating device or devices 130 is fixed permanently either to the frame part 150 of the calender or to support members by means of which the heating device 130 can be shifted further apart from the calender rolls, e.g., in connection with a web W break or with servicing.

The various details of the present invention may vary within the scope of the inventive concepts set forth above which have been presented for the sake of example only. Therefore, the preceding description of the present invention is merely exemplary, and is not intended to limit the scope thereof in any way.

TABLE 1

| Quality | 1 | 2 | 3 |
|---|---|---|---|
| Density ($g/cm^3$) | 4.9 | 4.0 | 3.2 |
| Bending strength 20° C. ($N/mm^2$) | 340 | 400 | 830 |
| $K_1C$ ($MN/m^{3/2}$) | 3.7 | 4.4 | 5.0 |
| Coefficient of elasticity (GPa) | 310 | 360 | 500 |
| Thermal expansion coefficient ($10^{-6}$/°C.) | 6.2 | 5.3 | 5.5 |
| Resistance to thermal shock (°C.) | 550–600 | 250–300 | 300–350 |
| Specific resistance ($cm \times 10^{-5}$) | 2.1 | 6.5 | 50 |

In Table 1 above, the quality 1 is the ceramic material marketed by Messrs. Asahi Glass under the product name "Ceraborex."

The coefficients of thermal conductivity of the composite ceramics 1, 2 and 3 at different termperatures are as follows:

| | RT | 200° C. | 400° C. | 600° C. |
|---|---|---|---|---|
| quality 1 | 34.3 | 44.4 | 41.5 | 37.9 |
| quality 2 | 21.4 | 14.2 | 13.2 | 13.5 |
| quality 3 | 24.6 | 25.9 | 23.5 | 22.0 |

The numbers are given in the unit $\frac{Kcal}{m \cdot hr \cdot °C.}$

What is claimed is:

1. Method for heating an outer face of a cylinder or roll in direct contact with a paper or paperboard web pressed thereagainst, comprising the steps of inductively heating the outer cylinder or roll face from outside a mantle of the cylinder or roll, by using a magnetic field, whereby a heating effect based upon eddy currents is produced in an outer layer of the cylinder or roll, providing as said outer layer, an outer layer of electrically conductive ceramic material, whereby said resistive heating effect is concentrated in said outer layer, restricting depth of penetration of said heating effect in a radial direction of the cylinder or roll to be heated by at least one of the steps of choosing thickness of said ceramic outer layer, and choosing electrical frequency of said induction heating, and/or choosing said ceramic material of said outer layer so that the cylinder or roll face has necessary strength properties both in view of wear resistance and in view of thermal shock caused by said heating effect.

2. The method of claim 1, which is used in a machine for manufacturing paper or paperboard.

3. The method of claim 2, which is applied in conjunction with hot pressing of said paper or paperboard web, with the cylinder or roll forming at least one roll of a nip.

4. The method of claim 3, wherein said face is heated to a temperature of about 140°–500° C.

5. The method of claim 2, which is applied in conjunction with dewatering-pressing in the paper or paperboard machine, with the heated cylinder or roll forming at least one press nip with an unheated press roll, whereby said heating of said face intensifies said pressing or promotes detaching of the paper or paperboard web from said heated cylinder or roll.

6. The method of claim 5, wherein the heated cylinder or roll is a central roll of greater diameter than respective adjacent press and press suction rolls in a press section of the machine.

7. The method of claim 5, wherein said heating effect is applied at a point at which the paper or paperboard web is detached from said heated cylinder or roll and passed further along.

8. The method of claim 6, wherein said heating effect is applied at a point at which the paper or paperboard web is detached from said central roll of said press section and passed further along.

9. The method of claim 2, which is applied in conjunction with calendering of said paper or paperboard web, with the heated cylinder or roll being a calender roll in that it functions with an adjacent roll to press paper or paperboards therebetween.

10. The method of claim 9, comprising forming a stack of several calendering rolls, with said cylinder or roll inductively heated being an extreme roll of said stack.

11. The method of claim 10, additionally comprising inductively heating two of said rolls and providing them with respective ceramic outer layers, both said thusly heated rolls being extreme rolls in the calendering stack.

12. The method of claim 1, wherein said inductive heating effect is confined to said ceramic outer layer, by the additional step of excluding any conduction of heat by means of an electrically insulating inner layer situated underneath said electically conductive ceramic outer layer.

13. The method of claim 12, wherein said inner layer is also thermally-insulating.

14. The method of claim 1, wherein specific resistance of the electrically conductive ceramic material in said outer layer is lower than said about $10^{-2}$ Ωm.

15. The method of claim 14, wherein said specific resistance is about $2\text{–}8\times10^{-5}$ Ωcm.

* * * * *